US005758372A

United States Patent [19]

Lopez Diaz

[11] Patent Number: 5,758,372

[45] Date of Patent: Jun. 2, 1998

[54] ADJUSTABLE MODULAR FRAMEWORK FOR MATTRESS BASES

[75] Inventor: Fernando Lopez Diaz, Madrid, Spain

[73] Assignee: Fabricas Lucia Antonio Betere, S.A., Madrid, Spain

[21] Appl. No.: 874,939

[22] Filed: Jun. 13, 1997

[51] Int. Cl.[6] ..... A47C 19/00

[52] U.S. Cl. ..... 5/200.1; 5/308; 5/201; 5/412

[58] Field of Search ..... 5/11, 58, 183, 5/184, 185, 200.1, 201, 202, 412, 308

[56] References Cited

U.S. PATENT DOCUMENTS

| | | | |
|---|---|---|---|
| 3,737,925 | 6/1973 | Oxford | 5/308 X |
| 3,745,596 | 7/1973 | Copeland | 5/308 |
| 3,887,950 | 6/1975 | Wachsman | 5/11 |
| 3,987,503 | 10/1976 | Kean | 5/11 X |
| 4,263,683 | 4/1981 | Knoke | 5/200.1 |
| 5,020,173 | 6/1991 | Dreyer, Jr. | 5/308 |

FOREIGN PATENT DOCUMENTS

| | | | |
|---|---|---|---|
| 768234 | 2/1957 | United Kingdom | 5/58 |

*Primary Examiner*—Michael F. Trettel
*Attorney, Agent, or Firm*—Schweitzer Cornman Gross & Bondell LLP

[57] ABSTRACT

Structured in modular fashion based on two sides (1–1'), a head (2) and a foot (2') standing as independent parts fixable by means of corner members (3), both the length and the width may be adjusted at will, by means of a greater or lesser degree of plugging or overlap of the corner members (3) with respect to the sides, head and foot (1–2). Furthermore, each side (1–1') has a pair of connecting rods (8) hinged thereto which are hinged at their top end to two bolsters (9) that form part of the mattress platform or base as such, said bolsters being also independent in respect of each other and having fluted fittings (11) on their inner face in which rigid or flexible crosspieces (12) making up the platform may be plugged to a greater or lesser extent, to adjust its width at will, said bolsters (9) moreover having telescopic terminals (10) at their ends that in turn permit the length of the platform to be adjusted.

11 Claims, 5 Drawing Sheets

ADJUSTABLE MODULAR FRAMEWORK FOR MATTRESS BASES

FIELD OF THE INVENTION

The present invention relates to a supporting frame for a mattress, of a structure to permit its dimensions to be adjusted both lengthwise and crosswise, and enabling disassembly that minimizes the space that it takes up in storage and transportation.

The frame is provided with lifting means for the mattress support to permit an easy access to the space defined within the frame.

BACKGROUND

Mattress supporting frames usually have a more or less rigid framework often from two rectangular frames that overlie one another, have rounded corners and are connected by a short upright, rigid supporting base for a mattress or box spring. This kind of frame structure usually requires that it be of the same size as the mattress, and takes up much volume when stored after its manufacture and during its transportation and also requires the manufacture of specifically dimensioned frames for each mattress size with the obvious drawbacks that this entails.

These drawbacks become emphasized when the space defined within the frame is to be used as storage space such as for bed linen or of any other object because then the mattress has to be lifted to provide access to the storage space.

SUMMARY OF THE INVENTION

The frame structure of the present invention solves the drawbacks set out above, and by using a number of structurally simple and basic members of little volume, frames of variable widths and/or lengths can be obtained with means to have access to the space defined therewithin.

The mattress supporting frames of the present invention are constructed in a modular fashion starting with two side supports which are identical with each other, head and foot cross bracing members, which are likewise identical with each other, all of which can be interconnected through bracing and corner elements, which can involve metal members, wood boards, or mixed structures, and in the case of metal members can employ telescopically coupled tubes to be able to adjust the effective length, the sides and the head and the foot to suit the dimensions of the frame to any size mattress both as to its length and width. The bottom frame also results in a container chest with a top that can be opened.

A pair of connecting rods are suitably articulated on the inner face of each of the two sides of the frame and are likewise articulated at their top ends to top side supports that have a plurality of fittings on their inner surfaces to accommodate cross pieces thus to make up the mattress supporting platform. The width of the mattress supporting platform can be adjusted by having the crosspieces inserted into the fittings to a greater or lesser extent, or by using crosspieces of varying length, to adapt it to the width of the mattress and to the bottom portion of the frame. Both the bottom part of the frame and its top structure can be upholstered or encased, thereby concealing the frame structure of the unit.

The connecting rods can be assisted by resilient members to ease the lifting effort the operative surface of the frame. Lifting of the top frame is enabled parallel to the supporting base, rendering bed-making operations easier.

In accordance with another feature of the present invention, the frame side supports can receive telescoping terminals at their ends, also provided with hollow side fittings for the cross members slats, and thus the length of the operative surface of the mattress platform can be adjusted by these telescoping terminals.

BRIEF DESCRIPTION OF THE DRAWING

To provide a fuller description and contribute to the complete understanding of the characteristics of this invention, a drawing is attached wherein.

DETAILED DISCLOSURE

Figure 1:
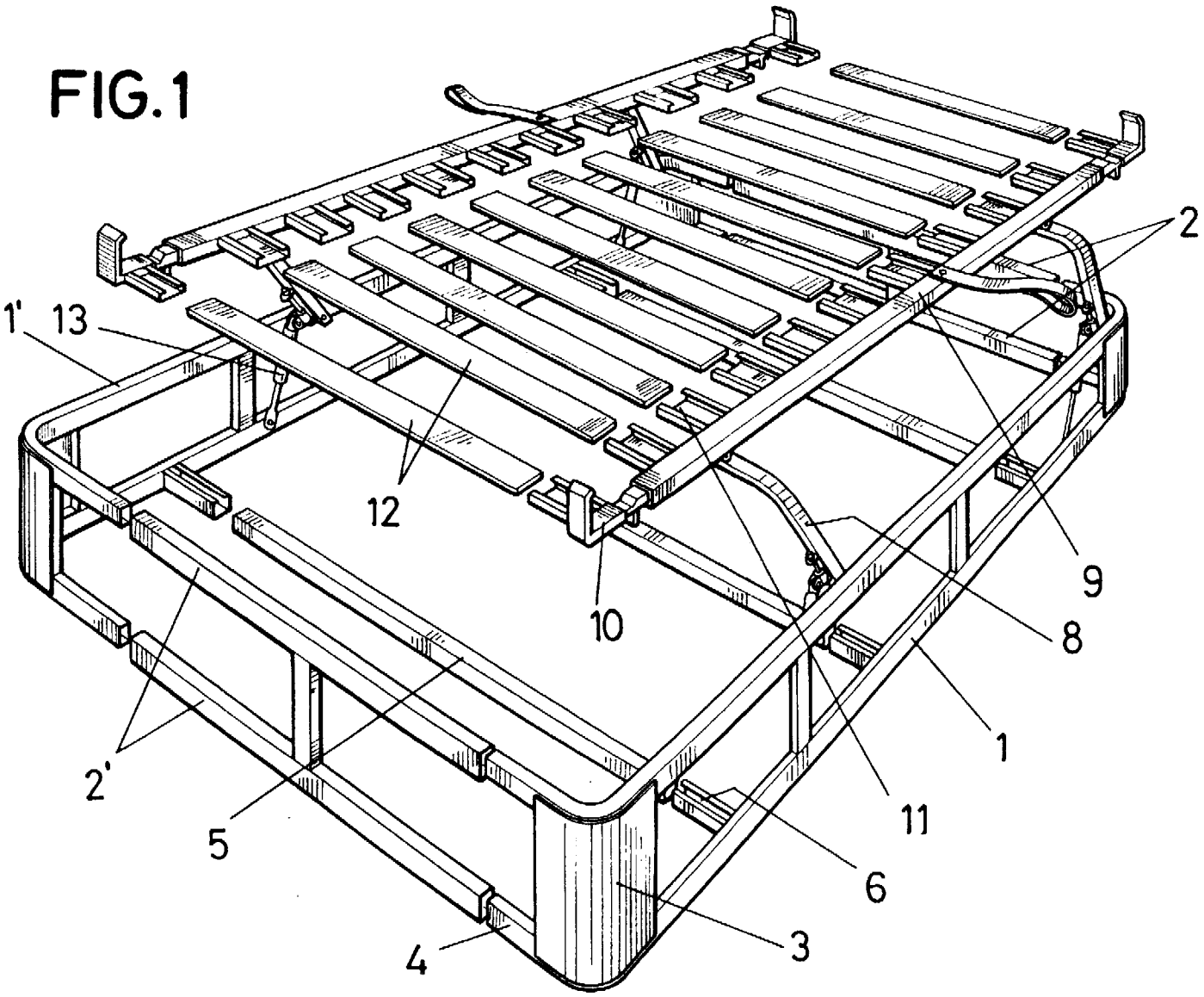
FIG. 1 is an exploded perspective view of an adjustable modular framework for a mattress base according to a particular embodiment of the present invention with a metal structure.
Figure 2:
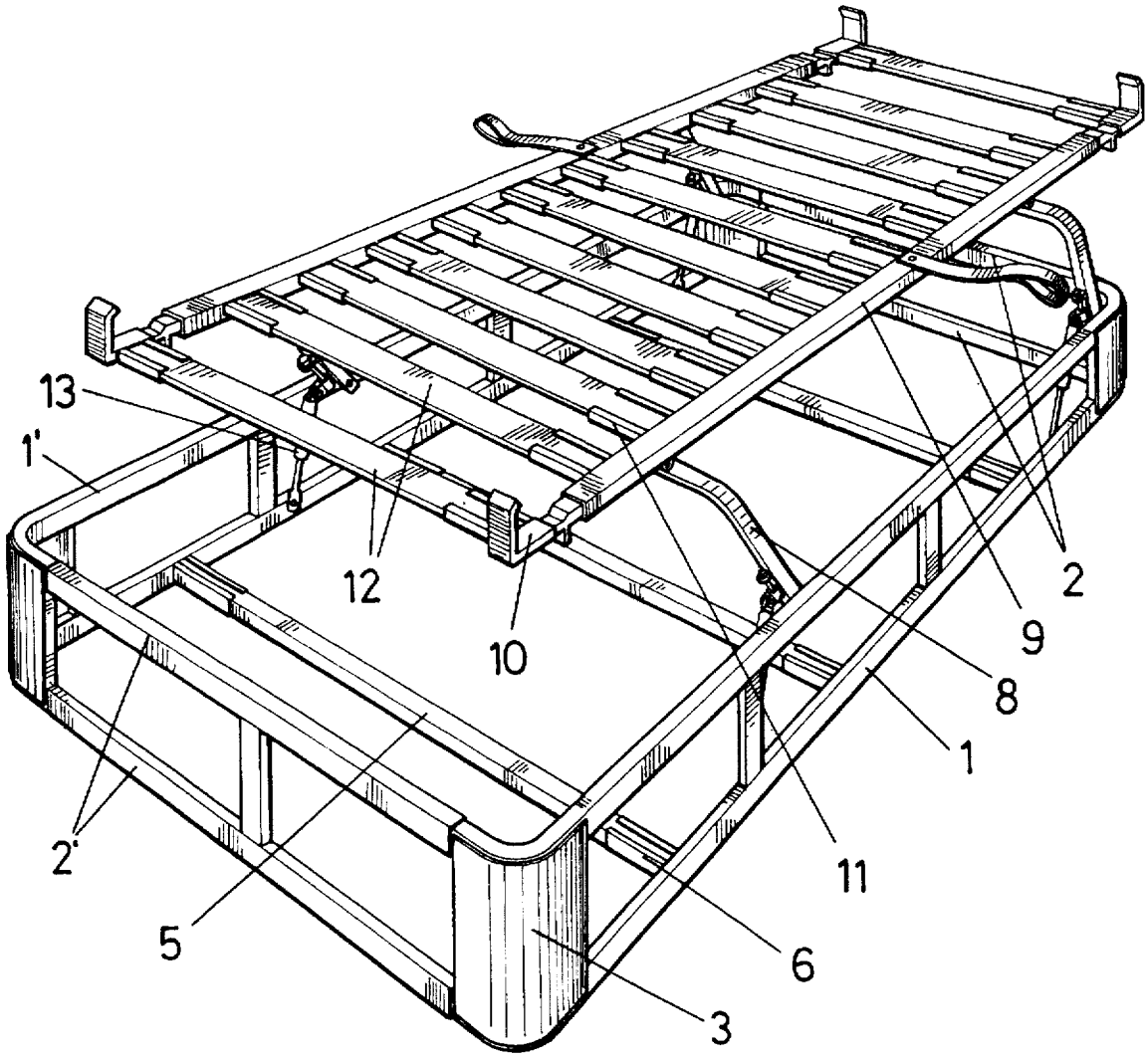
FIG. 2 is another perspective view of the assembled unit of FIG. 1, with the platform in the raised position to show its structure more clearly.

The frame of the present invention, particularly with reference to FIG. 1, has a pair of side supports 1, 1' comprising two parallel horizontal framing members connected to each other by upright members, and head and foot cross members 2, 2' that are perpendicular thereto and coupled to it by right angled corner members 3 with extensions 4 for being telescopically coupled to the horizontal framing members and the cross members 2, 2' to adjust the dimensions of the rectangular frame formed thereby as desired, and more particularly to adapt to various mattress sizes, in both width and length.

Figure 3:
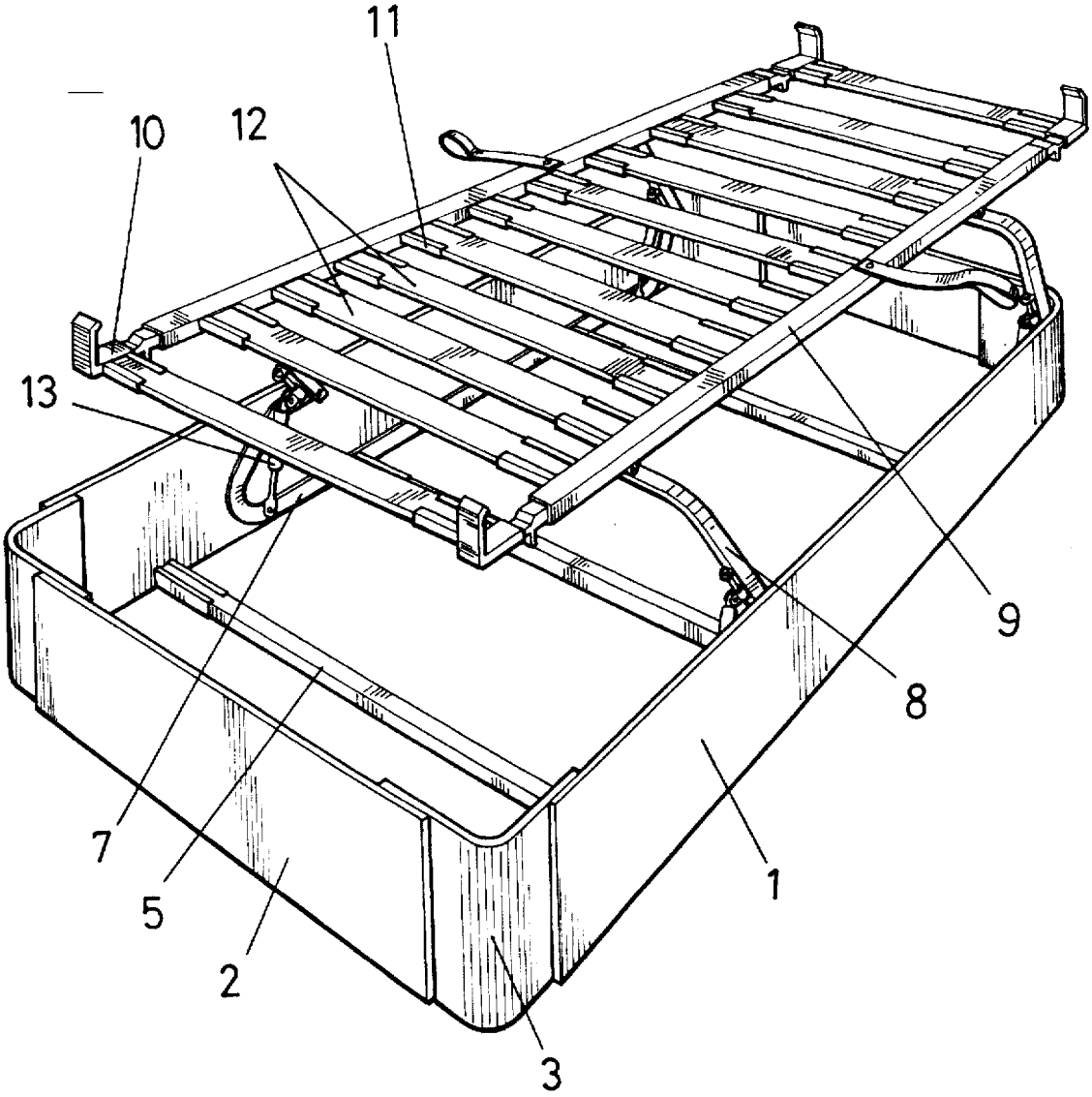
FIG. 3 is a representation resembling that of FIG. 2, with the bottom portion of the frame made from a combination of wood boards and metal frames.
Figure 6:
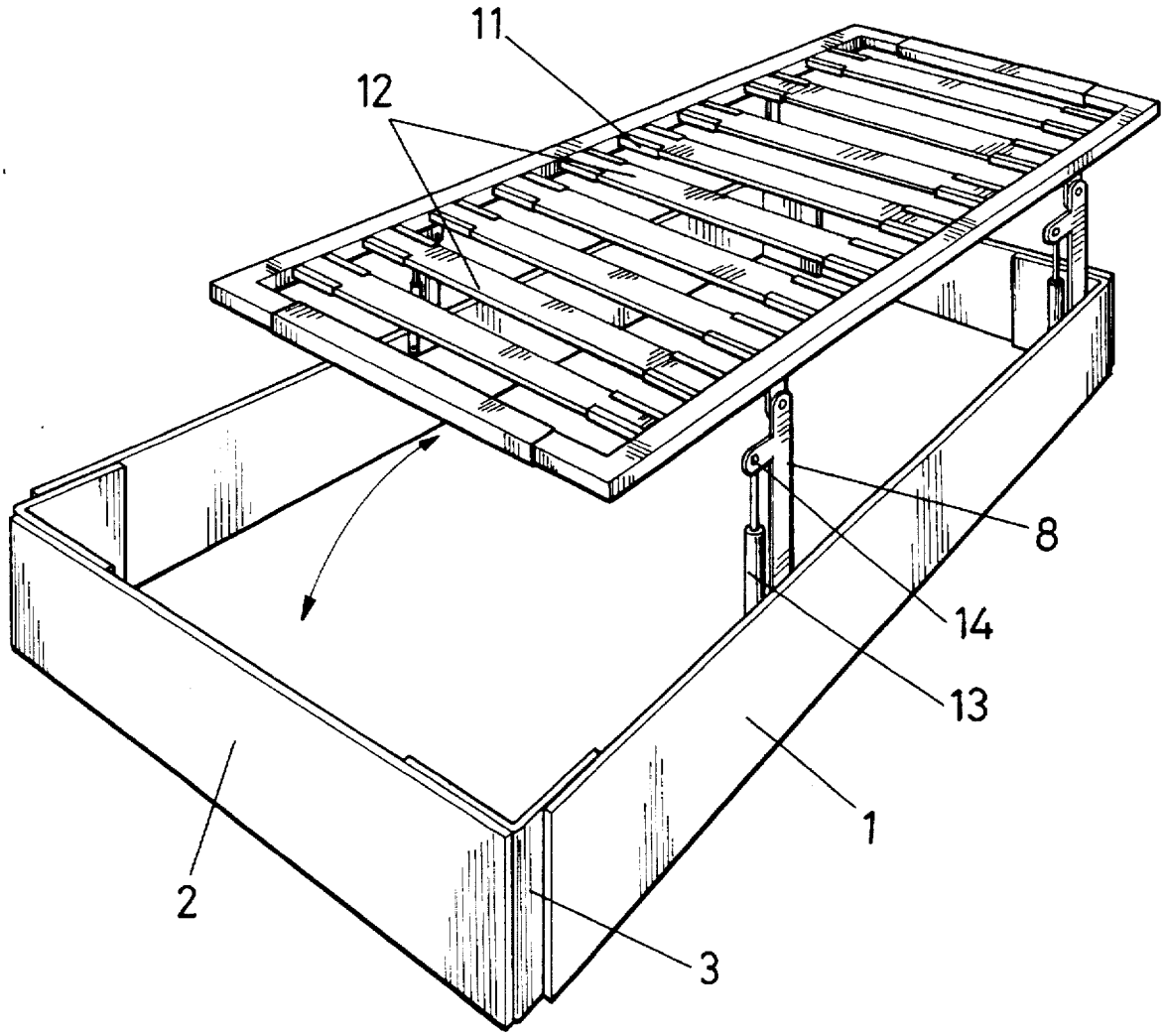
FIG. 6 is, another alternative embodiment of the present invention, somewhat different than that of FIG. 3.

The framing members and cross members can be suitably made of metal or wood boards, as shown e.g. in FIGS. 3 and 6. In the case of wood boards the length and width adjustment can be achieved by a greater or lesser degree of overlapping of the corner members 3.

This bottom frame thus formed can also be used as a storage chest or an enclosed area that is open at the top.

The side supports 1, 1' are suitably interconnected at the bottom by a plurality of crosspieces 5, which can be coupled to the supports through hollow extension fittings 6, to stiffen the framework structure, without impairing the intended possibility of adjusting the width of the framework.

Connecting rods 8 are linked directly to the side supports 1, 1' when they are made of a metal, or when they are of wood (e.g. FIG. 3) then with the assistance of metal supporting brackets 7 attached to the wood side boards 1, 1'. In the latter case the fixed bottom portion of the frame is connected to a top platform that can be lifted therefrom. That top platform has a pair of side supports 9 with the connecting rods 8 being attached thereto by hinges, with the side supports 9 ending in telescopic attachments 10 which permit a limited length adjustment of the side support 9. These side supports have lateral telescopic fittings 11 which, similarly to the fittings 6, can receive the ends of cross pieces 12 which can be rigid or flexible and constitute the platform or operative surface of the frame onto which the mattress is to be laid. Therefore the width of the platform can be adjusted at will by telescopically coupling the crosspieces 12 in the fittings 11. Similarly, the length of the frame is adjusted through the telescopic attachments (10).

The top liftable base that supports the mattress or the box spring of the mattress is lifted parallel to its supporting surface, thereby making bedding operations easier and avoiding the need for users to bend to carry out such activity. This top liftable base is also the lid or cover of the bottom chest container.

Both the bottom chest or enclosure, and its liftable top lid can be upholstered and/or encased to provide a more pleasing appearance to the eye and conceal the framework or structure of the unit.

Figure 5:
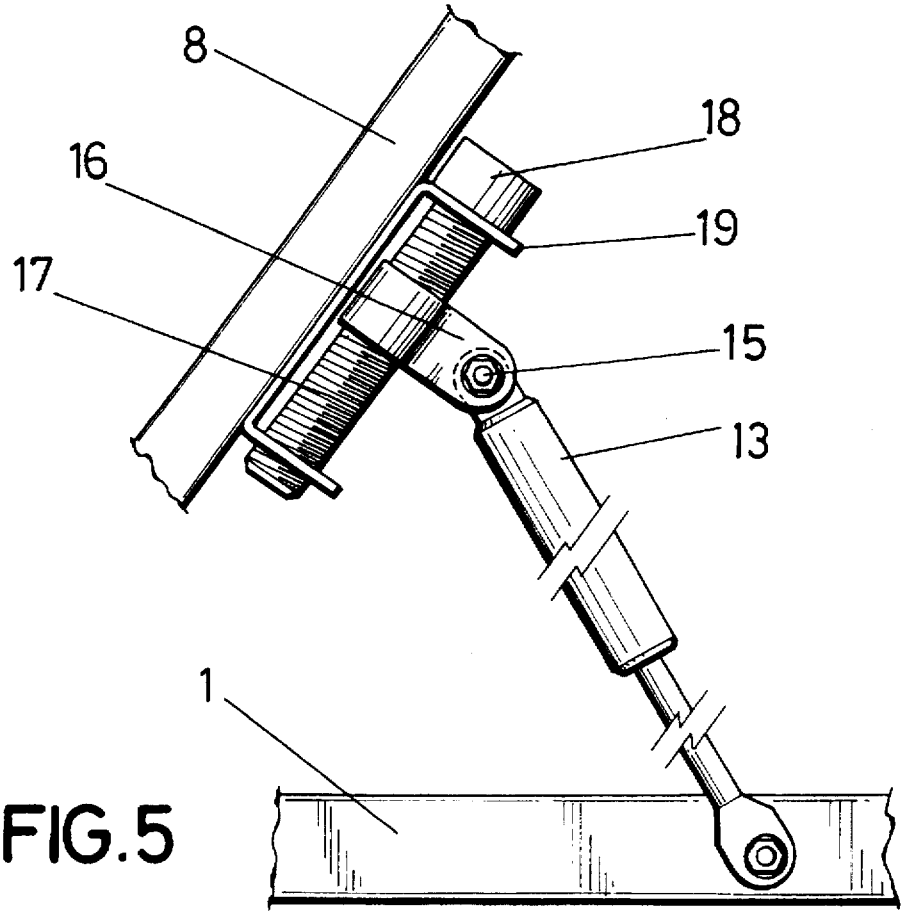
FIG. 5 is a closeup view of the attachment and adjustment of a pneumatic spring for lifting the mattress platform.

The connecting rods 8 can be suitably assisted by pneumatic springs 13 which make the platform easier to lift and can be hinged from lugs 14 of the connecting rods 8, as shown, for example in FIG. 6. The spring 13 can also be adjusted by tensioning as shown in the closeup view of FIG. 5, where the pneumatic spring 13 articulated by a hinge 15 to a nut 16 mounted upon a screw 17 acting as a spindle. Rotation of the screw 17 causes the nut 16 to move along the screw as the head 18 of the screw is rotated. The screw 17 is axially held within a bracket 19 locked to its respective connecting rod 8.

Figure 4:
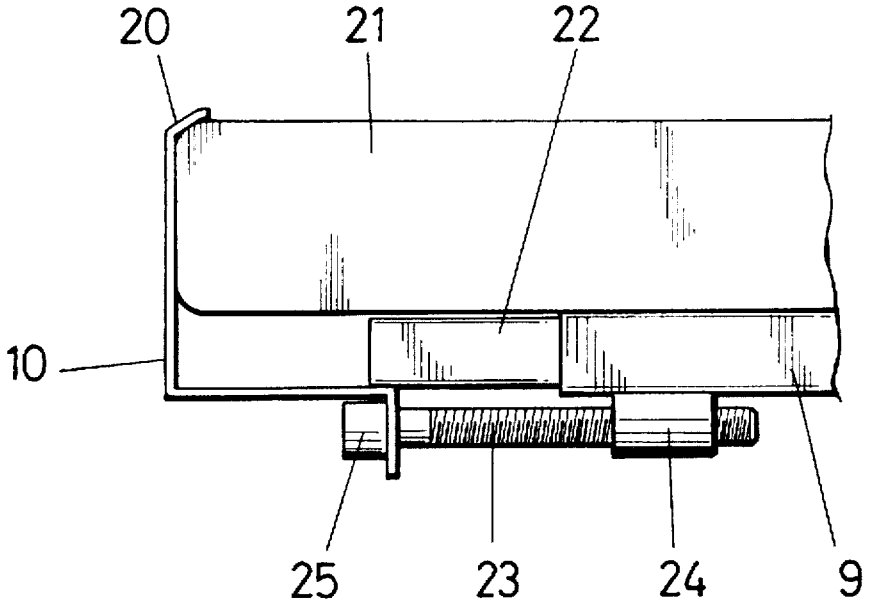
FIG. 4 is an enlarged side elevation closeup view of one of the adjustable ends of one of the side supports of the mattress platform.

To adjust the length of the side supports 9 as shown in FIG. 4, a telescopic attachment 10 having a top extension 20, is provided to hold the mattress or box spring 21. A guide 22 is adapted to move within the hollow interior of the side supports 9, to which the telescopic attachment 10 is locked, and a screw 23 can turn in a nut 24 locked to the end of the side support 9. Thus if the nut 24 with the attached side support 9 is held still, turning the head 25 of the screw 23 will move the screw 23 and the telescopic attachment axially in either direction. Thus a lengthwise adjustable frame is obtained based upon a substantially linear configuration of its members, requiring, a minimal space during storage and transportation, and which are easy to interconnect during assembly and which permit easy adjustment of both the length and the width of the mattress base to be adjusted, as required. Moreover a space is provided within the frame, that can be used for storage of bed linen or any other object, and this space can be opened simply by lifting the platform or operative surface of the frame.

I claim:

1. An adjustable modular supporting frame for a mattress, which comprises (A) a base having (i) elongated base side supports disposed in parallel to each other, (ii) elongated base end cross braces disposed in parallel with each other for adjustably interconnecting the ends of said elongated base side supports, and (iii) a corner attaching member for adjustably interconnecting respective ends of said base side supports and base end cross braces, said base side supports and base end cross braces each having a vertical width for defining a base storage space enclosed within said base supports and base end cross braces, (B) a mattress-supporting platform adapted to cover said base storage space from above, and having (i) elongated platform side supports, said platform side supports each having two ends and an inside face, and (a) adjustable terminals at their respective ends for adjusting the lengths of said side supports to the length of a mattress to be placed thereon; and (b) a plurality of fittings on their inside faces, (ii) elongated platform end supports for interconnecting the ends of said platform side supports, and (iii) a plurality of platform cross members having their respective ends disposed within said fittings for adjustably interconnecting said elongated platform side supports, and (C) a plurality of connecting rods attached to said base side supports for supporting said mattress-supporting platform above said base storage space.

2. The adjustable modular supporting frame of claim 1, wherein said connecting rods are also attached to said elongated platform side supports for substantially horizontal lifting of said mattress supporting platform above said base for facilitating bedmaking and for providing access through the top of said storage space.

3. The adjustable modular supporting frame of claim 1, wherein said elongated base side supports and said base end cross braces are of a metal, and said elongated base side supports and said base end cross braces each comprises at least two elongated metal members in a vertically parallel disposed relationship, and one or more vertical bracing members for interconnecting each of said at least two elongated metal members to provide a elongated base side supports and base end cross braces of a width determined by the length of said vertical bracing members.

4. The adjustable modular supporting frame of claim 3, further comprising a resilient member connected between a connecting rod and a metal base side support.

5. The adjustable modular supporting frame of claim 4, further comprising a screw shaft spindle mounted from and parallel to said connecting rod, a screw shaft follower nut adapted to be moved on said spindle, and said resilient member is articulated from said screw shaft follower nut from said spindle.

6. The adjustable modular supporting frame of claim 5, wherein said resilient member is a pneumatic spring.

7. The adjustable modular supporting frame of claim 1, wherein one or more of said elongated base side supports and of said base end cross braces is a wood board of predetermined width.

8. The adjustable modular supporting frame of claim 7, further comprising a metal support for said connecting rod, and a resilient member connected between said metal support and a wood board base side support.

9. The adjustable modular supporting frame of claim 1, further comprising an upholstery cover over said base and said mattress supporting platform for concealing the structure therein.

10. The adjustable modular supporting frame of claim 1, wherein said elongated base side supports have inside faces and comprise a plurality of fittings on the inside faces, and the base further comprises a plurality of parallel base cross members adjustably inserted in said fittings on the inside faces of said base side supports, for interconnecting said base side supports and adjustably spacing them from each other.

11. The adjustable modular supporting frame of claim 1, wherein said platform side supports each have a telescoping extension at at least one end thereof, the supporting frame further comprising a screw shaft spindle attached for rotation to either a telescoping extension or an associated platform side support, and a screw shaft follower nut attached to the other than to which said screw shaft spindle is attached, for extending and withdrawing said telescoping extension for adjusting the length of said platform side support.

* * * * *